US006649233B1

(12) United States Patent
Baker

(10) Patent No.: US 6,649,233 B1
(45) Date of Patent: Nov. 18, 2003

(54) INKJET INK IMAGE RECORDING ELEMENT

(75) Inventor: Julie Baker, Harrow (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/575,285

(22) Filed: May 22, 2000

(51) Int. Cl.[7] ..... B41M 5/00

(52) U.S. Cl. ..... 428/32.25; 428/32.26; 428/32.27; 428/32.29; 428/32.3; 428/32.38

(58) Field of Search ..... 428/195, 478.2, 428/478.4, 478.8, 32.25, 32.26, 32.27, 32.29, 32.3, 32.38

(56) References Cited

U.S. PATENT DOCUMENTS 4,649,064 A * 3/1987 Jones
5,789,070 A 8/1998 Shaw-Klein et al.
5,948,912 A * 9/1999 Yuan et al.

* cited by examiner

*Primary Examiner*—Pamela R. Schwartz
(74) *Attorney, Agent, or Firm*—Harold E. Cole

(57) ABSTRACT

An image recording element for inkjet ink images comprises, in the following order, a support, an absorbent base layer; and, a top layer which is ink receptive and comprises one or more hydrophilic polymers, gelatin, a crosslinking agent for gelatin and a humectant.

9 Claims, No Drawings

INKJET INK IMAGE RECORDING ELEMENT

FIELD OF THE INVENTION

This invention relates to inkjet ink imaging, particularly inkjet ink image recording elements.

BACKGROUND OF THE INVENTION

In a typical inkjet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water, an organic material such as a monohydric alcohol or a polyhydric alcohol or a mixed solvent of water and other water miscible solvents such as a monohydric alcohol or a polyhydric alcohol.

The recording elements typically comprise a support or a support material having on at least one surface thereof one or more ink-receiving or image-forming layers. The elements include those intended for reflection viewing, which usually have an opaque support, and those intended for viewing by transmitted light, which usually have a transparent support.

While a wide variety of different types of image-recording elements for use with inkjet ink devices have been proposed heretofore, there are many unsolved problems in the art and many deficiencies in the known products which have severely limited their commercial usefulness. The requirements for an image-recording medium or element for inkjet recording are very demanding.

It is well known that in order to achieve and maintain photographic-quality images on such an image-recording element, the recording element must:

- Be readily wetted so there is no puddling, i.e. coalescence of adjacent ink dots, which leads to nonuniform density.
- Exhibit no image bleeding.
- Exhibit the ability to absorb high concentrations of ink and dry quickly to avoid elements blocking together when stacked against subsequent prints or other surfaces.
- Provide a high level of gloss and be sufficiently insoluble in typical ink solvents to avoid development of differential gloss.
- Exhibit no discontinuities or defects due to interactions between the support and/or layer(s), such as cracking, repellencies, comb lines and the like.
- Not allow unabsorbed dyes to aggregate at the free surface causing dye crystallization, which results in bloom or bronzing effects in the imaged areas.
- Have optimized image fastness to avoid fade from contact with water or radiation by daylight, tungsten light, or fluorescent light.

Inkjet ink image recording elements often have an overcoat or top layer coated on top of another ink-absorbing layer, particularly if the underlying layer contains gelatin or polymer. The overcoat layer can have various functions, such as to provide physical protection, reduce tackiness, provide a glossy appearance, offer an ink-receptive surface, carry specific components or allow easier manufacture. Overcoat layers are usually relatively thin in comparison to the thick underlying layer typically used for ink-jet receivers, often in the order of one micron in thickness and can comprise a variety of materials, including cellulose derivatives.

Methylcellulose and its derivatives possess characteristic thermal gelling, surfactant, non-ionic, thickening, film-forming, and adhesive properties coupled with extremely low toxicity. In addition, it is possible to adapt these materials to specific end uses by controlling the type and ratio of their modifying substituents as described in "Industrial Gums. Polysaccharides and their derivatives", Whistler, R. L., Academic press, Inc, 2nd edition, 1973. Thus, they have found application in a wide range of products including use in inkjet ink recording media.

U.S. Pat. No. 5,789,070 describes an image recording element for inkjet ink images comprising, in the following order, a support, a base layer and a top layer, wherein:

- the base layer comprises a hydrophilic material e.g. gelatin;
- the top layer is ink receptive and comprises a cationically modified cellulose ether having the structure:

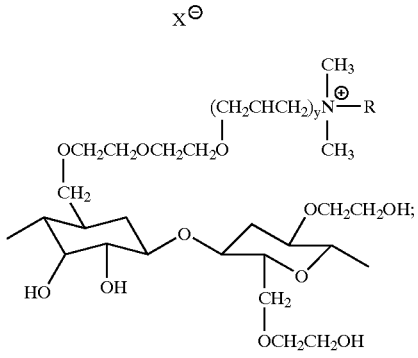

wherein

R represents $C_nH_{2n+1}$;

X represent halide; and n is 1 to 30.

The present invention is concerned with improving the drying time of an image recording element for inkjet ink images.

It has been found that if the polymer e.g. gelatin laydown of an underlying ink-absorbing layer is increased, the time taken to dry a printed image (measured as the density of an image transferred to a piece of plain paper sandwiched to the printed image immediately after it exits the inkjet printer) can be reduced. However, to achieve a significant improvement in this measure, the polymer laydown in the ink-absorbing layer has to be almost doubled (e.g. 13.9 g/m$^2$ compared to 7.6 g/m$^2$). This also results in an undesirable variability in gloss levels produced by different printed colours (signified by an increase in differential gloss, that is, the standard deviation of the gloss measurements taken from eight different colours).

The invention solves the problems associated with increasing the polymer content of an underlying ink-absorbing layer and avoids a large increase in the polymer content of the recording element.

SUMMARY OF THE INVENTION

The invention provides an image recording element for inkjet ink images comprising, in the following order,

- a support;
- an absorbent base layer; and,
- a top layer which is ink receptive and comprises one or more hydrophilic polymers, gelatin, a crosslinking agent for gelatin and a humectant.

The addition of gelatin, a crosslinking agent for gelatin and a humectant to a conventional overcoat layer consisting of hydrophilic polymers results in a significant improvement in both dry time and differential gloss.

DETAILED DESCRIPTION OF THE INVENTION

In the present invention, the recording element can be opaque, translucent, or transparent. Thus, the supports utilized in the recording element of the present invention are not particularly limited and various supports may be employed. Accordingly, plain papers, coated papers e.g. resin-coated papers, various plastics including a polyester-type resin such as poly(ethylene terephthalate), poly (ethylene naphthalate) and polyester diacetate, a polycarbonate-type resin, a fluorine-type resin such as ETFE, metal foil, and various glass materials can be employed as supports. When the supports are transparent, a transparent recording element can be obtained and used as a transparency in an overhead projector.

The supports employed in the present invention must be self-supporting. By "self-supporting" is meant a support material such as a sheet of film that is capable of independent existence in the absence of a supporting support.

The thickness of the support can be from 12 to 500 $\mu$m, preferably from 75 to 300 $\mu$m.

If desired, in order to improve the adhesion of the base layer to the support, the surface of the support may be corona-discharge-treated prior to applying the solvent-absorbing layer to the support or, alternatively, an undercoating, such as a layer formed from a halogenated phenol or a partially hydrolyzed vinyl chloride-vinyl acetate copolymer can be applied to the surface of the support.

The base layer is primarily intended as a sponge layer for the absorption of ink solvent. As such, it is primarily composed of hydrophilic or porous materials. It may have a thickness of 3 to 60 $\mu$m.

Hydrophilic materials include gelatin, acetylated gelatin, phthalated gelatin, oxidized gelatin, chitosan, poly(alkylene oxide), poly(vinyl alcohol), modified poly(vinyl alcohol), sulfonated polyester, partially hydrolyzed poly(vinylacetate/vinyl alcohol), poly(acrylic acid), poly(1-vinylpyrrolidone), poly(sodium styrene sulfonate), poly(2-acrylamido-2-methane sulfonic acid), and polyacrylamide and mixtures of these materials. Copolymers of these polymers with hydrophobic monomers may also be used.

The hydrophilic material may be coated to provide a laydown of 3 to 60 g/m$^2$, preferably 5 to 12 g/m$^2$.

Other materials useful in the base layer include cellulose derivatives, gum derivatives, chitin starch, or other materials which are obvious to those skilled in the art.

A porous structure may be introduced into the base layer by the addition of ceramic or hard polymeric particulates, by foaming or blowing during coating, or by inducing phase separation in the layer through introduction of nonsolvent.

A porous structure could be achieved by coating the ceramic or hard polymeric particulates to provide a laydown of 3 to 60 $\mu$g/m$^2$, preferably 20 to 50 $\mu$g/m$^2$.

In general, it is sufficient for the base layer to be hydrophilic, but not porous. This is especially true for photographic quality prints, in which porosity may cause a loss in gloss. Optionally, rigidity may be imparted to the base layer through incorporation of a second phase such as polyesters, poly(methacrylates), and polyvinyl benzene-containing copolymers.

In the preferred embodiment of this invention, the base layer is comprised of 50%–100% photographic-grade gelatin. The remainder of the layer may consist of a polymer or inorganic material compatible with said gelatin which does not adversely impact functional properties.

In yet another embodiment, a mordant may be added in small quantities (2%–10% by weight of the base layer) to further improve waterfastness. Useful mordants are disclosed in U.S. Pat. No. 5,474,843.

In particular, the base layer may consist of any hydrophilic polymer or combination of polymers with or without additives as is well known in the art.

The top layer comprises one or more hydrophilic polymers. Examples of suitable hydrophilic polymers include cellulose derivatives e.g. nonionic cellulose ethers, anionic cellulose ethers and cationic cellulose ethers; polyvinyl alcohol, polyvinylpyrrolidone and sulfonated polyesters.

Useful cationically modified cellulose ether polymers include Celquat SC240C (hydroxyethyl cellulose reacted with trimethylammonium chloride substituted epoxide; National Starch and Chemical) and Quatrisoft LM-200 (hydroxyethyl cellulose reacted with a dodecyl dimethylammonium chloride substituted epoxide; Amerchol Corp.). A combination of A4M. (methyl cellulose) and JR400 (hydroxyethyl cellulose reacted with a trimethyl ammonium chloride substituted epoxide) in a weight ratio of 80/20 provides another useful example of materials useful in forming the image recording layer.

The hydiophilic polymers may be present in the top layer in an amount from 0.1 to 3.0 g/m$^2$, preferably from 0.5 to 1.5 g/m$^2$.

The top layer contains gelatin which may be present in an amount from 20 to 80 weight %, preferably from 40 to 60 weight % based on the weight of the hydrophilic polymer in the top layer.

Examples of suitable crosslinking agents for gelatin are well known and include the range of organic and inorganic hardeners described in "The Theory of the Photographic Process" Fourth Edition, Chapter 3, page 77.

A preferred crosslinking agent is bis(vinylsulfonyl) methane.

The crosslinking agent for the gelatin may be present in the top layer in an amount from 0.01 to 0.5 weight %, preferably from 0.03 to 0.1 weight % based on the weight of the gelatin in the top layer.

The top layer also contains a humectant. Examples of suitable humectants include polyhydric alcohols and derivatives thereof such as glycerol, diethylene glycol, triethylene glycol, diethylene glycol mono-butyl ether, triethylene glycol mono-butyl ether and triethanolaminne.

A preferred humectant is glycerol.

The humectant may be present in the top layer layer in an amount from 5 to 40 weight %, preferably from 10 to 30 weight % based on the total weight of the top layer.

Preferably, the top layer has a thickness of 0.1 to 3.0 $\mu$m.

Since the image recording element may come in contact with other image recording articles or the drive or transport mechanisms of the image recording devices for which its use is intended, additives such as surfactants, lubricants and matte particles may be optionally added the element to the extent that they do not degrade properties of interest.

The layers described above, including the base layer and the top layer, may be coated by conventional coating means onto a transparent or opaque support material commonly used in this art. Coating methods may include, but are not limited to wound wire rod coating, slot coating, slide hopper coating, gravure, and curtain coating. Some of these methods allow for simultaneous coatings of both layers, which is preferred from a manufacturing economic perspective.

The inks used to image the recording elements used in the present invention are well-known inks. The ink compositions used in ink-jet printing typically are liquid compositions comprising a solvent or carrier liquid, dyes or pigments, humectants, organic solvents, detergents, thickeners, and preservatives. The solvent or carrier liquid can be comprised solely of water or can be predominately water mixed with other water-miscible solvents such as polyhydric alcohols, although inks in which organic materials such as polyhydric alcohols are the predominant carrier or solvent liquid also may be used. Particularly useful are mixed solvents of water and polyhydric alcohols.

The dyes used in such compositions are typically water-soluble direct or acid type dyes. Such liquid compositions have been described extensively in the prior art including, for example, U.S. Pat. Nos. 4,381,946; 4,239,543 and 4,781,758.

Although the recording elements disclosed herein have been referred to primarily as being useful for ink-jet printers, they also can be used as recording media for pen plotter assemblies. Pen plotters operate by writing directly on the surface of a recording medium using a pen consisting of a bundle of capillary tubes in contact with an ink reservoir.

The following example further illustrates the invention and the benefits flowing therefrom.

EXAMPLE

For comparison with the invention, a resin-coated paper support, was coated on the back side with a gelatin layer to control curl. The front side was coated with, in order, a gelatin ink-absorbing layer and an overcoat layer comprising cellulose derivatives.

It was found that if the gelatin laydown of the underlying ink absorbing layer was increased, the time taken for a printed image to dry was reduced. However, to achieve a significant improvement in the dry time, the gelatin laydown in the ink absorbing layer had to be almost doubled (13.9 g/m$^2$ compared to 7.6 g/m$^2$). This also resulted in an undesirable variability in the gloss levels produced by different printed colours (signified by an increase in differential gloss, that is, the standard deviation of the gloss measurements taken from eight different colours).

By contrast and in accordance with the invention, considerably lower levels of gelatin (approximately 0.5 g/m$^2$), together with a humectant (e.g. glycerol) and a gelatin cross-linker (e.g. BVSM) were added to an overcoat layer consisting of cellulose derivatives. The result of these modifications was a significant improvement in both dry time and differential gloss, that is, a dry time equivalent to that achieved with an ink absorbing layer containing 13.9 g/m$^2$ of gelatin but with significantly lower differential gloss, making the difference in the level of gloss between areas of different printed colours much less noticeable (if the differential gloss is 5 or below, the gloss difference is extremely difficult to detect visually).

The ink-absorbing layer was coated at a gelatin laydown of 7.63 g/m2 and included 848 mg/m$^2$ of a cationic latex polymer [polymer of (m and p chloromethyl) ethenylbenzene and 2-methyl-2-propenoic acid 1,2-ethanediylester, quaternized with N,N-dimethylmethanamine] which acts as a mordant and 129.16 mg/m$^2$ of polymeric matte (limited coalescence polystyrene beads, 20 microns).

The overcoat consisted of a water soluble cationic cellulose ether (hydroxyethyl cellulose reacted with a dodecyl dimethylammonium chloride substituted epoxide) coated at 861.12 mg/m$^2$, methyl cellulose (average molecular weight 86,000) coated at 212.28 mg/m$^2$, to which was added gelatin, coated at 0.5 g/m$^2$, a humectant (glycerol) added at 23% of the dry laydown of the top layer and a gelatin cross linker (bis(vinyl sulfonyl)methane) at 0.00025 g/m$^2$ (0.05 weight % of the gelatin in the top layer).

The effect of this overcoat design in reducing the time taken for the printed image to dry was determined by measuring the density of ink transferred to a piece of plain paper sandwiched to a printed image immediately printing. The faster the sample dried, the lower the ink density on the plain paper.

The results in table 1 show the dry time ink density, % gloss, differential gloss and tackiness results for several gel laydowns in the ink absorbing layer (02G) and for some different overcoat formulations.

TABLE 1

| 02G Gel Laydown (g/m$^2$) | 03S Gel Laydown (g/m$^2$) | 03S Glycerol Laydown (%) | 03S BVSM Laydown (g/m$^2$) | HP P/S Dry Time Ink Density | HP P/S % Gloss | HP P/S Differential Gloss | Tackiness |
|---|---|---|---|---|---|---|---|
| 7.6 | — | — | — | 0.844 | 66.2 | 3.91 | OK |
| 10.9 | — | — | — | 0.547 | | | OK |
| 13.9 | — | — | — | 0.389 | 61.5 | 11.88 | OK |
| 7.6 | 0.5 | 23 | 0.00025 | 0.385 | 60.9 | 7.29 | OK |
| 7.6 | 0.5 | — | 0.00025 | 0.373 | 60.4 | 11.95 | S. Tacky |
| 7.6 | 0.5 | 23 | — | 0.385 | 62.5 | 8.37 | OK |

Key to Table 1:
02G represents the ink absorbing layer
03S represents the overcoat layer
HP P/S represents an HP Photo Smart printer
Tackiness:
OK = non tacky
S. Tacky = slightly tacky Printer set-up:

The HP PhotoSmart Printer was used with the following settings:

HP PhotoSmart Glossy Photographic Paper

"Best" print quality

PhotoSmart Best Colours

The results in Table I indicate that dry times equivalent to that achieved with an ink absorbing layer containing 13.9 g/m$^2$ of gelatin (but with significantly lower differential gloss) can be obtained by adding just 0.5 g/m$^2$ of gelatin to the overcoat.

If the gelatin is added to the overcoat in the absence of the humectant, dry time is unaffected but the coating becomes tacky and a larger differential gloss is seen. If the gelatin is added to the overcoat in the absence of a gelatin cross linker, dry time and gloss are unaffected, but a small increase in differential gloss is seen.

The data shown in Table 2 below indicate that this invention results in a reduction in the time taken to dry a printed image for two printers and ink sets. In this example, the experimental coating embodying the invention (Inv) transferred less ink in both cases when compared to a typical commercial product, in this case, Kodak Ink jet Photographic Quality Paper (Gen 2).

TABLE 2

| Coating | HP PhotoSmart Dry Time Ink Density | Epson Stylus Photo 700 Dry Time Ink Density |
|---|---|---|
| Gen2 | 0.844 | 2.231 |
| Inv | 0.380 | 0.803 |

Printer set-ups:

The HP PhotoSmart printer was used with the following settings

HP PhotoSmart glossy photographic paper

"Best" print quality

PhotoSmart best colours

The Epson Stylus Photo 700 printer was used with the following settings:

Photo quality ink jet paper 1440 dpi photo quality

What is claimed is:

1. An image recording element for inkjet ink images comprising, in the following order, a support;

an absorbent base layer including hydrophilic material, the hydrophilic material being coated to provide a laydown of 3 to 60 g/m$^2$ of said material, said base layer having a thickness of 3 to 60 $\mu$m and including a mordant and a polymeric matte; and a top layer which is ink receptive and comprises one or more hydrophilic polymers, gelatin, a crosslinking agent for gelatin and a humectant, the hydrophilic polymers being present in the top layer in an amount from 0.1 to 3.0 g/m$^2$, said top layer having a thickness of 0.1 to 3.0 $\mu$m, and wherein the gelatin in the top layer is in an amount from 20 to 80 weight % based on the weight of hydrophilic polymer in the top layer.

2. An image recording element according to claim 1 wherein the top layer comprises one or more hydrophilic polymers selected from nonionic cellulose ethers, anionic cellulose ethers, cationic cellulose ethers, polyvinyl alcohol, polyvinylpyrrolidone and sulfonated polyesters.

3. An image recording element according to claim 1 wherein the hydrophilic polymers are present in the top layer in an amount from 0.5 to 1.5 g/m$^2$.

4. An image recording element according to claim 1 wherein the gelatin is present in the top layer in an amount from 40 to 60 weight % based on the weight of the hydrophilic polymer in the top layer.

5. An image recording element according to claim 1 wherein the crosslinking agent in the top layer is bis (vinylsulfonyl)methane.

6. An image recording element according claim 1 wherein the crosslinking agent is present in the top layer in an amount from 0.03 to 0.1 weight % based on the weight of the gelatin in the top layer.

7. An image recording element according to claim 1 wherein the humectant in the top layer is selected from glycerol, diethylene glycol, triethylene glycol, diethylene glycol mono-butyl ether, triethylene, glycol mono-butyl ether and triethanolamine.

8. An image recording element according to claim 1 wherein the humectant is present in the top layer in an amount from 10 to 30 weight % based on the total weight of the top layer.

9. An image recording element according claim 1 wherein the hydrophilic material in the base layer comprises gelatin.

* * * * *